US008550650B1

(12) United States Patent
McGinty

(10) Patent No.: US 8,550,650 B1
(45) **Date of Patent: *Oct. 8, 2013**

(54) LIGHTED HELMET WITH HEAT PIPE ASSEMBLY

(76) Inventor: Patrick McGinty, Signal Mountain, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/195,120

(22) Filed: Aug. 1, 2011

Related U.S. Application Data

(60) Provisional application No. 61/372,138, filed on Aug. 10, 2010.

(51) Int. Cl.
*F21V 21/084* (2006.01)

(52) U.S. Cl.
USPC ..... 362/105

(58) Field of Classification Search
USPC ..... 362/105–106
See application file for complete search history.

(56) References Cited

U.S. PATENT DOCUMENTS

| | | | | |
|---|---|---|---|---|
| 4,195,328 | A | 3/1980 | Harris | |
| 5,173,839 | A | 12/1992 | Metz, Jr. | |
| 5,871,271 | A | 2/1999 | Chien | |
| 6,017,049 | A * | 1/2000 | Spector | 280/288.4 |
| 6,573,536 | B1 | 6/2003 | Dry | |
| 6,598,236 | B1 | 7/2003 | Gantt | |
| 6,799,864 | B2 | 10/2004 | Bohler et al. | |
| 6,827,130 | B2 | 12/2004 | Larson | |
| 6,831,303 | B2 | 12/2004 | Dry | |
| 6,882,532 | B2 | 4/2005 | Chen et al. | |
| 6,932,150 | B1 | 8/2005 | Yeh et al. | |
| 6,955,451 | B2 | 10/2005 | Coushaine et al. | |
| 6,999,318 | B2 | 2/2006 | Newby | |
| 7,010,813 | B2 | 3/2006 | Ahn et al. | |
| 7,040,388 | B1 | 5/2006 | Sato et al. | |
| 7,219,371 | B2 | 5/2007 | Liu | |
| 7,296,304 | B2 | 11/2007 | Goldsborough | |
| 7,489,031 | B2 | 2/2009 | Roberts et al. | |
| 7,701,708 | B2 | 4/2010 | Wu et al. | |
| 7,701,718 | B2 | 4/2010 | Yu et al. | |
| 7,708,053 | B2 | 5/2010 | Kroliczek et al. | |
| 7,719,839 | B2 | 5/2010 | Hoss et al. | |
| 7,721,789 | B2 | 5/2010 | Ueda et al. | |
| 7,723,835 | B2 | 5/2010 | Nakashima et al. | |
| 7,723,845 | B2 | 5/2010 | Henderson et al. | |
| 7,726,385 | B2 | 6/2010 | Mok | |
| 7,726,844 | B2 | 6/2010 | Chen | |
| 7,729,119 | B2 | 6/2010 | Yang | |
| 7,732,918 | B2 | 6/2010 | Dangelo et al. | |
| 7,733,654 | B2 | 6/2010 | Wang et al. | |
| 7,735,156 | B2 | 6/2010 | VanDerWoude et al. | |
| 7,736,032 | B2 | 6/2010 | Chen | |
| 7,740,054 | B2 | 6/2010 | Yang | |
| 7,742,306 | B2 | 6/2010 | Shuai et al. | |
| 7,743,819 | B2 | 6/2010 | Liu et al. | |

(Continued)

*Primary Examiner* — Anh Mai
*Assistant Examiner* — Hana Featherly
(74) *Attorney, Agent, or Firm* — Stephen J. Stark; Miller & Martin PLLC

(57) ABSTRACT

A heat dissipating helmet provides a heat dissipating heat pipe portion. One or more high powered LEDs may be in thermal contact therewith providing a significant portion of a heat sink to remove heat from the LEDs to maintain them at a proper operating temperature during operation. The heat dissipating material may be also in contact with air flow as the helmet moves through space thereby allowing convection to assist in removing heat from the helmet.

16 Claims, 8 Drawing Sheets

(56) References Cited

U.S. PATENT DOCUMENTS

| | | | | |
|---|---|---|---|---|
| 7,744,250 | B2 | 6/2010 | Lee et al. | |
| 7,744,257 | B2 | 6/2010 | Zhou et al. | |
| 7,746,640 | B2 | 6/2010 | Cao et al. | |
| 7,755,901 | B2 | 7/2010 | Shen | |
| 8,152,322 | B1 * | 4/2012 | McGinty | 362/105 |
| 2005/0213331 | A1 * | 9/2005 | Lewis | 362/294 |
| 2005/0265015 | A1 | 12/2005 | Salazar | |
| 2006/0126304 | A1 * | 6/2006 | Smalc et al. | 361/704 |
| 2007/0253188 | A1 * | 11/2007 | Klipstein et al. | 362/105 |
| 2008/0026638 | A1 | 1/2008 | Cohen et al. | |
| 2008/0080171 | A1 | 4/2008 | Lombard et al. | |
| 2008/0130299 | A1 | 6/2008 | Dorogi | |
| 2008/0150126 | A1 | 6/2008 | Zhou et al. | |
| 2008/0155991 | A1 * | 7/2008 | Lee | 62/3.2 |
| 2008/0170382 | A1 | 7/2008 | Mass et al. | |
| 2010/0013101 | A1 * | 1/2010 | Hedler et al. | 257/773 |
| 2011/0074270 | A1 * | 3/2011 | Van De Ven et al. | 313/46 |

* cited by examiner

LIGHTED HELMET WITH HEAT PIPE ASSEMBLY

CLAIM OF PRIORITY

This application claims the benefit of U.S. Provisional Patent Application No. 61/372,138 filed Aug. 10, 2010.

FIELD OF THE INVENTION

The present invention relates to lighted helmets, and more preferably to a lighted helmet having LEDs utilizing heat pipe technology.

BACKGROUND OF THE INVENTION

Lighting on helmets is not new. U.S. Pat. No. 4,195,328 shows an early lighting system providing for an auxiliary headlight to be mounted on a safety helmet 26. The light utilizes a halogen quartz lamp 124 with a reflector 126. In order to address heating concerns, slots 114,118 with a perforated lens cover 116 so as to "permit a dissipation of any internal heat from lighting elements." Such a heat removal system would probably work for halogen lighting but would not be expected to satisfactory remove heat from a high power LED. Other lighted helmet constructions include U.S. Patent Application Nos. 2008/0080171, 2008/0170382, 2008/026638 and 2005/0265015.

U.S. Pat. No. 5,871,271 discusses the use of a ten candle power LED as a headlight which would appear to be a low power LED. A common conversion in the green light spectrum is believed to be 680 lumens per watt. 12.7 lumens are a candle power. A conversion of ten candle power to watts provides what appears to be a LED having a maximum output wattage of approximately 0.2 watts. High power LEDs are commonly provided today are at least one, if not five or ten watts. A principal difference between high and low power LED is that a low power LED may provide sufficient lighting so that a rider might have increased visibility for safety concerns, while a high power LED would be much better suited for use as a headlight to illuminate a source at a distance. The headlight of the '271 patent is not expected to provide significant illumination at a distance.

Even though U.S. Pat. No. 5,871,271 discloses the use of a ten candle power LED: "the headlight or reading function can be enhanced by using high brightness LEDs such as the 10 candlepower white LEDs manufactured by Toshiba Corporation, "high power LEDs are not a viable commercial option at this time. Furthermore, based on the construction of placing the LEDs in a recess of the hard shell outer layer and not providing any separate heat removal capability as is shown in FIGS. 2, 3*a* and 3*b*, a high power LED substituted for a low power LED in that construction would result in burn out almost instantaneously due to the heat buildup and absence of a heat sink (low power LEDs do not normally require a heat sink of any significant size). The '271 patent is believed to show the use of lights on bicycle helmets principally for the use of identifying the rider as opposed to illumination as a headlight.

References such as U.S. Pat. No. 6,955,444 show a surgical head light in which high powered LEDs are employed such as a one watt and a five watt LED which explicitly describe the need for a heat sink. There is no room for this bulky heat sink in constructions such as the '271 patent. The '444 patent describes a five watt LED requiring a heat sink four times that use for a one watt LED. The applicant and the owner of the '444 patent have found that when purchasing an LED strong enough to provide headlights which can be clamped on to the head of the user such as on the helmet, that the heat sinks are heavy and bulky and thus "contribute[s] to discomfort for the wearer of the head mounted lamp" (Column 1, lines 45-48). In order to overcome the discomfort of heat sinks for high powered LEDs at five watts, this owner of the '444 patent used three watt LEDs so that smaller heat sinks could be employed with such constructions than would otherwise be required for higher wattage bulbs.

Of course, references are available directed to various LED heat sinks such as U.S. Pat. No. 6,799,864, U.S. Pat. No. 7,040,388, U.S. Pat. Nos. 5,173,839, 7,489,031, 6,827,130 and 6,999,318 and probably others. Similarly, there are patents related to the cooling of helmets such as U.S. Pat. Nos. 6,598,236, 7,219,371, 7,296,304, 7,010,813 and others.

Nevertheless, in spite of the prior art related to the general idea of providing a helmet with LEDs or providing a head lamp for the head of a user, the applicant believes that a lightweight helmet without a separate bulky high power LED heat sink is needed for at least some applications with improvements over the prior art are believed to be necessary in various applications.

Heat pipe technology has long been used in various devices for the efficient removal of heat away from heat sources which are particularly susceptible to the heat generated by their operation. Heat pipe technology utilizes the concept of latent heat of vaporization of a working fluid contained in a closed container such as a pipe form. In the phase change from liquid to vapor phase a large amount of heat can be absorbed and transfer from a "hot side" to a "cold side" of the container. The container itself is typically a tube and oriented in a way that maximizes this transfer of heat. The working fluid can be any of a number of substances depending on the particular operating temperature range at which the device is to be maintained. Examples of this are U.S. Pat. No. 7,701,708 B2 which utilizes heat pipes to remove heat from a CPU in a computer to a radiator fin assembly. Similarly, U.S. Pat. No. 7,719,839 B2 claims use of a heat pipe for transfer of heat to a radiator "cold plate" with the ability to add different sized radiator assemblies to the heat pipe in order to increase the quantity of heat the system can dissipate. Fujitsu designed and patented a heat pipe assembly, U.S. Pat. No. 7,721,789 B2, which as its goal was to provide a more form of a heat pipe base cooling apparatus for use in a variety of devices. The unique nature of Fujitsu's device is the u-shaped configuration allowing for the required length of pipe for expansion of the working fluid as it changed to the gas phase. They sited the problem addressed by their device as that of size of previous heat pipe cooling devices which require long segments of straight pipe to achieve cooling and thus arrived at their U or V shaped configuration. They then pass their heat pipe through radiator fins to remove the heat from their heat pipe. U.S. Pat. No. 7,723,845 B2, U.S. Pat. No. 7,723,835 B2, U.S. Pat. No. 7,746,640 B2, U.S. Pat. No. 7,740,054 B2 and U.S. Pat. No. 7,742,306 B2 have in common use of heat pipe type conductors as one component of an assembly directed at moving heat away from the heat generating source to a heat radiating structure such as a fin assembly with or without additional air moving fans/ventilation to increase conductive cooling at the radiator.

Over the past few years, use of heat pipes to specifically cool light emitting diodes (LEDs) has been the subject of a variety of patents. Heat pipes, being very compact and efficient conductors of heat lend themselves very naturally to incorporation into lighting devices utilizing LEDs as the light source due to the heat sensitive nature of LEDs and their requirement to be maintained below some maximum operating temperature to avoid damage to the light-generating phosphor element. In U.S. Pat. No. 7,726,844 B2, an LED is mounted to a heat dissipating device which utilizes a hollow chamber filled with a working fluid but does not specifically claim the use of a heat pipe in terms of the unique benefit of liquid to gas (and gas to liquid, i.e. condensation) phase change for transfer of heat. U.S. Pat. No. 7,744,257 B2, U.S. Pat. No. 7,744,250 B2, U.S. Pat. No. 6,831,303 B2, U.S. Published Patent Application No 2008/0150126 A1, and U.S. Pat. No. 7,736,032 B2 are all patents for devices that utilize heat pipes in various configurations to couple LEDs to adjacent heat sink and/or heat radiating fins that have been incorporated into the overall design as the cold side of the heat pipe. These patents deploy heat pipes in the conventional manner as part of their overall design and that is as a heat conduit for the express purpose of movement of heat between the heat source and the heat sink element of their device.

The use of heat pipes as conductors/conduits for the movement of heat is the routine method in which they are incorporated as parts of large devices and machines. U.S. Pat. No. 7,32,918 B2 is a device that takes a new step in the realm of heat pipe technology in that it takes advantage of carbon nanotube technology to further increase the efficiency of heat transfer from the heat source to the working fluid where the liquid to gas phase change can move heat to the top of the chamber and into a hollow pin fin structure. In the hollow pins the vapor can condense and thereby transfer heat to a large surface are to be radiated/conducted to the surrounding atmosphere.

SUMMARY OF THE INVENTION

It is an object of at least some embodiments of the present invention to provide an improved helmet with high power LED headlight system.

It is another object of at least some embodiments of the present invention to provide an improved helmet having an integral external shell portion utilized as at least a portion of a heat pipe and sink in cooperation with high power LED lights.

It is another object of at least some embodiments of the present invention to provide an improved bicycle, helmet having an exterior shell in which may be incorporated a heat conducting heat pipe system with a plurality of "hot pads", on its hot side, onto which high-power LEDs are mounted. The heat pipe functions to conduct heat from the hot side by absorbing heat into a working fluid that vaporizes and then travels by expansion in the gas phase into the cold side of the pipe where it condenses back to liquid on the inner surfaces of the pipe thereby conveying the heat to that area of the heat pipe.

It is another objective of at least some of the embodiments of the present invention to provide a novel configuration for a heat pipe mentioned utilized with a helmet. The heat pipe may be formed of a material preferably having a conductivity over 5 W/m*K (such as aluminum, carbon and/or other material), if not over 30 W/m*K or even over 100 or 200 W/m*K capable of maintaining the integrity/functionality of the working fluid undergoing vaporization/condensation and/or possibly, as well as, conducting heat into the hot side and out of the cold side without the aid of added heat radiating attached heatsinks.

Heat may be expelled from the heat pipe system through fins that may be integrally constructed along with the heat pipe lumen and may be part of the heat pipe itself. The heat released through condensation of the working fluid in the cold side of the heat pipe may be conduction directly through the wall of the heat pipe to the fins possibly without the need to traverse any material interface. The interior of the heat pipe may contain a working fluid having an appropriate boiling point which could be matched or otherwise selected relative to the manufacturer recommended operating temperature range of the LEDs intended to be cooled by the heat pipe system. The interior of the heat pipe may also contain a compatible wick or return intended to facilitate return of the condensed working fluid from the cold side to the hot side of the heat pipe in order to continue the phase change cycle integral to the efficient function of the heat pipe.

It is another object of at least some embodiments of the present invention to provide an improved helmet having a thermal conductive material shell portion possibly in thermal communication with a thermal transport system assisting in transporting heat from the scalp of a user to the thermal conductive portion.

In accordance with a presently preferred embodiment of the present invention, a helmet is constructed with a heat dissipating material portion connected to or possibly comprising at least a portion of an exterior shell that may provide the dual function of providing at least a portion of the structural protective shell exterior portion as well as a thermal dissipating surface area (a/k/a heat sink) for maintaining appropriate operation regarding temperature control of high powered LEDs connected to the helmet. The thermal conductor may also assist in dissipating heat from the head of the user which may be facilitated by having a higher thermal conductivity than traditional helmet material and need not necessarily be a part of the shell for at least some embodiments. Furthermore, one or more heat moving elements can be utilized to assist in transferring heat from the wearer's scalp to the heat dissipating material portion. The heat moving element could be as simple as a damp cloth or other structure or more complicated structures such as a liquid filled tubing system which could direct heat from the scalp to the thermal conducting material or elsewhere.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
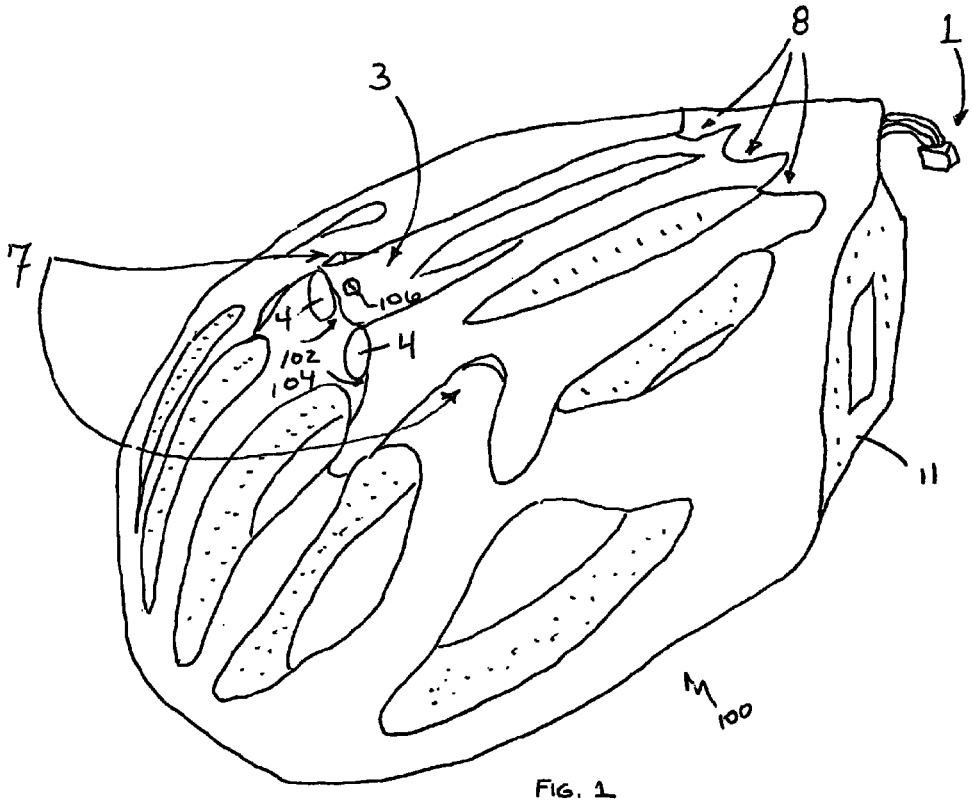
FIG. 1 is a front perspective view of a helmet constructed in accordance with a presently preferred embodiment of the present invention.

Helmet 100 of FIG. 1 is preferably constructed to include an outer or primary exterior shell 2 having a heat pipe assembly 5 between the primary exterior shell 2 and the heat pipe shell 3.

Helmet 100 of FIG. 1 is illustrated as a bicycle helmet, but other safety helmets are contemplated as well in various embodiments. As shown in FIG. 1, the LED optics 4 may be fully protected by the heat pipe shell 3 which also may at least assist in forming the forward facing heat pipe air vents 7. The heat pipe shell 3 may at least assist in completely protecting one or more heat pipes in a heat pipe assembly 5 from blunt and sharp impacts and may have rear facing exhaust vents as illustrated. The primary shell 2 may be intimately adhered to the underlying protective shell 11 which may be made of polystyrene and/or another suitable shock absorbing material. Securing straps are not shown but would be employed for most safety helmets 100 as a harness to firmly hold the helmet on the wearers head.

Figure 6:
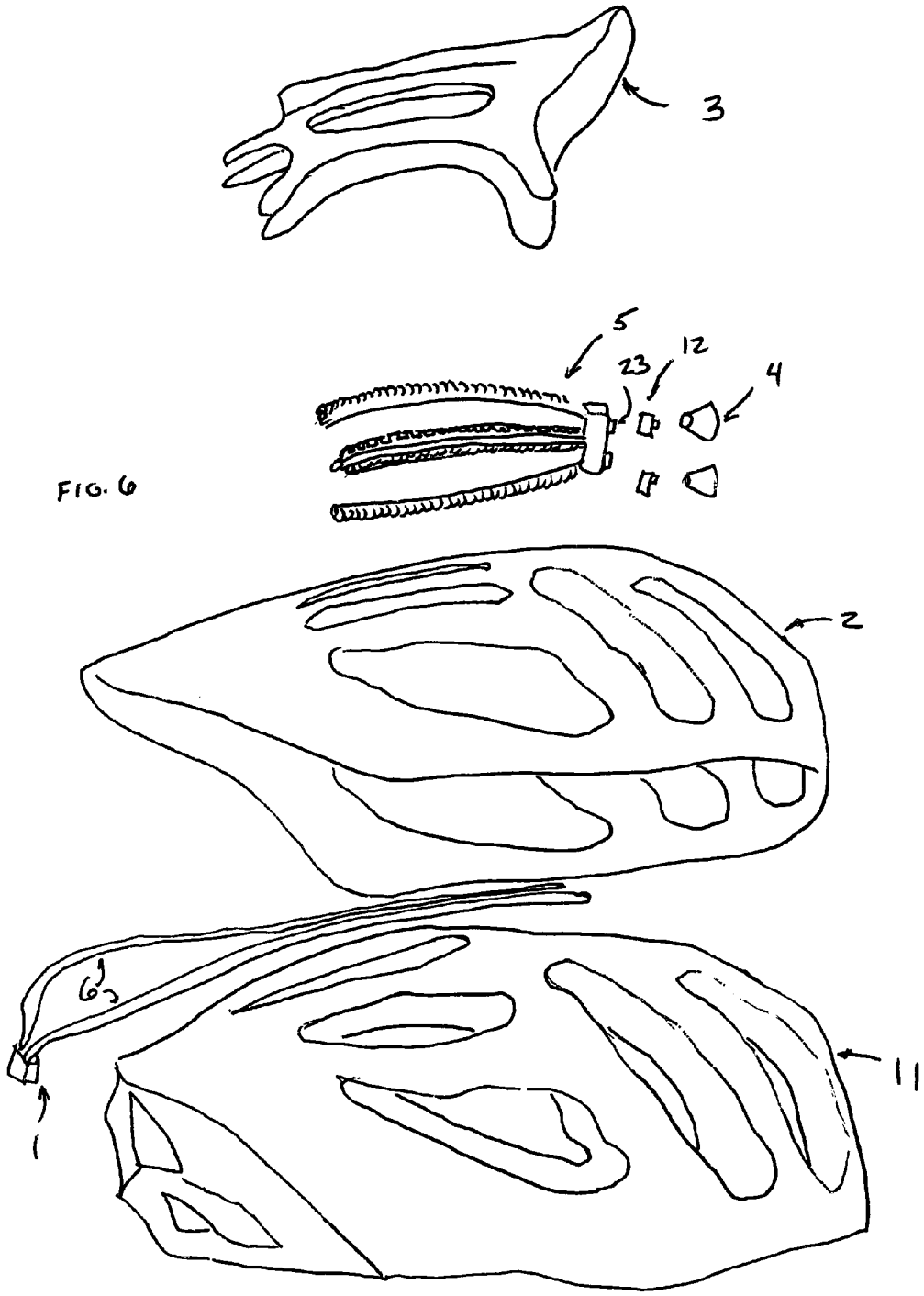
FIG. 6 is an exploded view of the helmet shown in FIG. 3.
Figure 10:
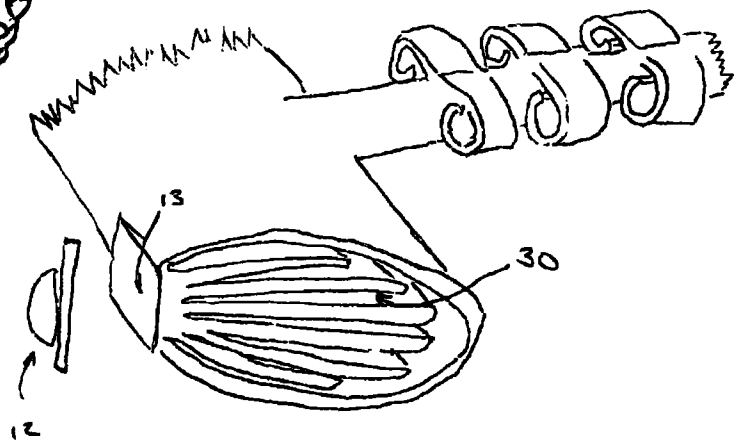
FIG. 10 is a cross section view along line B of FIG. 9 showing a profile of at least some embodiments of the front section tube with internal projections and flat pad with led for reference.
Figure 9:
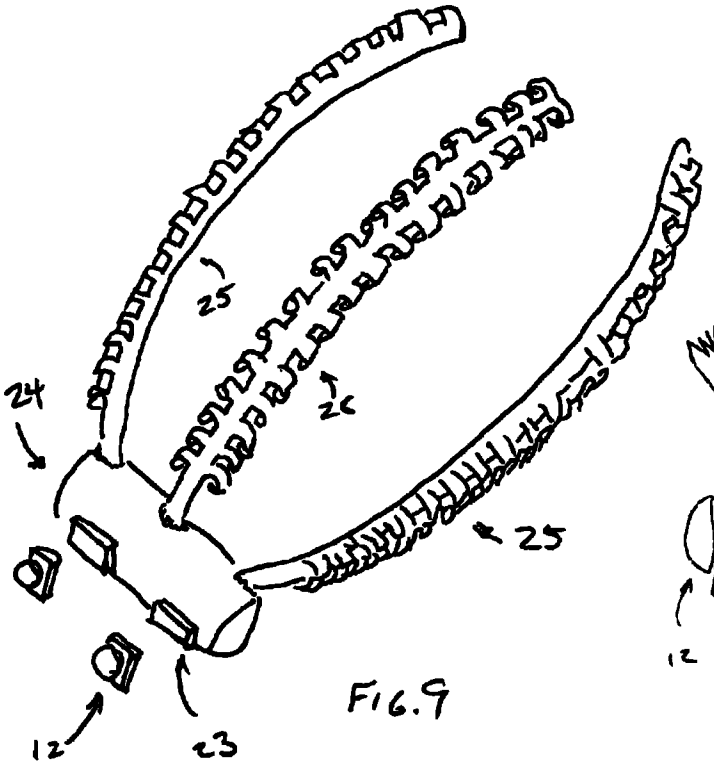
FIG. 9 is a top perspective view of the 3 pipe configured heat pipe portion shown in FIG. 2 connected to LEDs.

The helmet FIG. 10 of the preferably preferred embodiment has at least one and preferably a plurality such as two or three LEDs (Light Emitting Diodes) 12 which can be seen in an exploded detail view in FIGS. 6 and 9. The heat pipe assembly 5 may provide a mounting surface 23 for LEDs 12 as well as provide heat dissipating surface area as is typically necessary for maintaining appropriate operating temperatures of high power LEDs such as LED 12 shown in FIGS. 6 and 9. Furthermore, as will be explained below, the heat dissipating material 28 which could include aluminum and/or other thermally conductive metal or other material such as carbon (preferably having a conductivity over 5 W/m*K, if not over 30 W/m*K or even over 100 or 200 W/m*K). Other materials may also assist in dissipating heat from the head of a wearer as will be discussed in further detail below.

Instead of requiring large bulky heat sinks which are normally located immediately behind LEDs which would otherwise result in the spacing of the LED light source away from an exterior shell 2 of the helmet 100 in FIG. 1, the applicant has discovered a rather unique way of incorporating heat pipes with or into an outer shell assembly 2 and 3. One purpose of incorporating the heatpipe assembly 5 at least partially intermediate the primary shell 2 and the heat pipe shell 3 thereby potentially protecting the heat pipe assembly 5 from damage during normal use and to protect the wearer for the heat pipe assembly 5 during impacts to the helmet 100 during use. Other heat pipe assemblies may be exposed in other embodiments.

Figure 2:
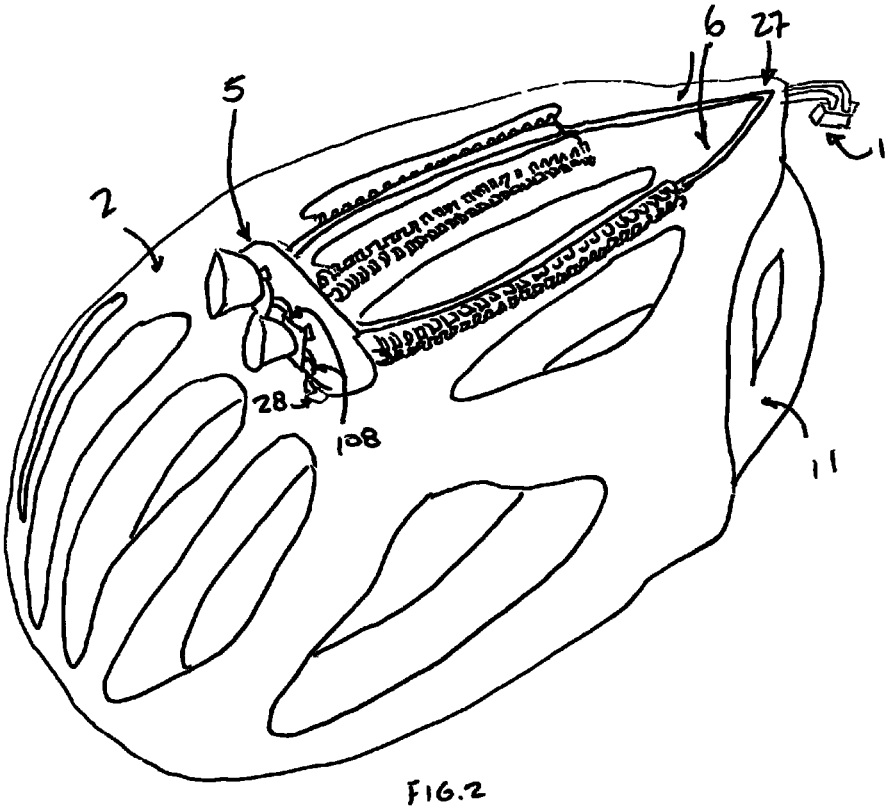
FIG. 2 is a top perspective view of the helmet of FIG. 1 with the heat pipe protective shell removed to show the orientation of the heat pipe and led with optics attached as well as the wiring harness in place.

Wearability of the helmet 100 in FIG. 1 is also believed to be improved as a bulky separate heat sink is preferably not attached towards the front of the helmet 100 rather the mass of the heat pipe assembly 5 is preferably substantially less than a conventional heatsink and the mass of the heat pipe assembly 5 is preferably distributed over a large portion of the helmet 100 as is seen in FIG. 2. The heat pipe assembly 5 extends rearwardly past a center of the helmet 100 and may be curved for at least some embodiments as illustrated. The features may provide increased comfort and a safer helmet 100 than prior art configurations by lessening neck fatigue and reducing movement of the helmet on the wearers head caused by torsional effects of the light's mass on top of the helmet 100.

Heat pipe assembly 5 may be any size such as at least one quarter or at least one half of exterior shell 12 or other appropriate size with any number of heat pipe attachments as 25, 26 as is allowed by the helmet design. Heat pipe assembly 5 provides at least a portion of a heat sink for at least one, two and preferably all three LEDs 12.

Helmet 100 of FIG. 1 can be a multipurpose day/night light helmet 100. The optics 4 are preferably low profile and of the collimating lens type or parabolic reflector type depending on the embodiment. Optics may be housed internal to slots 102, 104 formed between the primary shell 2 and the heat pipe shell 3 so that LED 12 is recessed within the slot 102 or 104. In the illustrated embodiment, optics 4 may extend above the upper surface of the heat pipe shell 3 and are external to the primary shell 2 as in FIGS. 1 and 2, but this may not be the case for all embodiments. Optics 4 may be removable by fasteners 106 to the heat pipe shell 3 in order to change the nature of the beam produced and also to break away in the event of impact to the helmet 100.

LEDs 12 are preferably high power LEDs meaning that they require at least about a watt of power if not about 5 watts or even 40 watts and preferably provide at least 300 lumens at $I_f$=2800 milliamps if not 1000 lumens watts or at least 200 lumens with an $I_f$ of 1400 milliamps. The particular high performing LEDs utilized by the applicant were Model No. SST-90-W, manufactured by Luminus Devices, Inc. which provides a super high flux and high lumination, high current operation and low thermal resistance. Other high power LEDs 12 may be utilized in other embodiments. Traditional applications for these high power LEDs 12 have been display backlighting, automotive forward lighting, architectural lighting, projection light sources, traffic signals, etc. Information about this LED product can be found at www.luminus-.com.

High intensity LED light sources such as LEDs 12 are preferably directional in nature to be configured for various applications, although in at least one embodiment high power LED light sources can be forward facing for use as a headlight or spotlight like here. Other possible embodiments could have LEDs 12 configured in a wide beam pattern such a flood lighting for helmets used in fire-rescue or mining/spelunking activities and/or have other characteristics.

As can be seen from FIG. 6 and FIG. 9, the LEDs 12 are preferably connected at pads 23 which are flat surfaces on the surface of the heat pipe assembly 5. Other connections could be provided in contact therewith. The pads 23 may be portions of the heat pipe assembly 5 constructed by forming flat areas on the heat pipe assembly 5 such as by either attaching a pad 23 to the pipe, by increasing the thickness of the heat pipe assembly wall 24 in the area the pad 23 may be located and preferably forming a flat surface by removing the material of the heat pipe wall 24 that was thicked to provide for the pad 23, or otherwise. The flat pad 23 may be nearly perfectly flat to maximize contact with the rear of the LED 12 which will be connected to it for some embodiments. The flat surface of the pad 23 defines the direction of light radiating from LED 12 once the LED 12 is connected and that direction is at a 90 degree angle with the surface of the pad 23. Other embodiments may have different structure.

The heat pipe assembly 5 in FIG. 9 represented in the current embodiment with three heat pipe segments 25 and 26. There may be more or less segments 25,26 in number depending on the amount of heat energy to be dissipated, the particular environment in which the helmet is intended for use as ambient air temperature affects the heat dissipating efficiency of the heat pipe assembly 5, and/or other design characteristics and/or criteria. FIG. 9 shows a large hollow front section 24 that may be round, oval, or other shape to which are attached the heat pipe segments 25 and 26. A large hollow front section 24 may be constructed to include internal projections 30 for the purpose of increasing the internal surface area. The heat pipe segments 24 and 25 may be welded, or in some other way connected if not bonded, to the front section 24 in a way that preferably maintains a vacuum tight continuous inner chamber wherein is contained the working fluid of the heat pipe assembly with all segments communicating with one another through the front section 24. In other embodiments and arrangements the front section 24 may merely consist of a section of the heat pipe segments 25 and 26 which are free of heat dissipating fins which are replaced by a pad 23 in an orientation in accordance with the desired function of that particular embodiment.

The heat pipe segments 25 and 26 of the heat pipe assembly 5 are partially or entirely constructed of a material such as aluminum having a thermal conductivity of or greater than 200 W/m*K. The heat pipe segments 25, 26 as seen in FIG. 9, serve as both the heat pipe lumen which contains the working fluid under partial vacuum and the heat radiating/heat sinking portion of the helmet.

Figure 7:
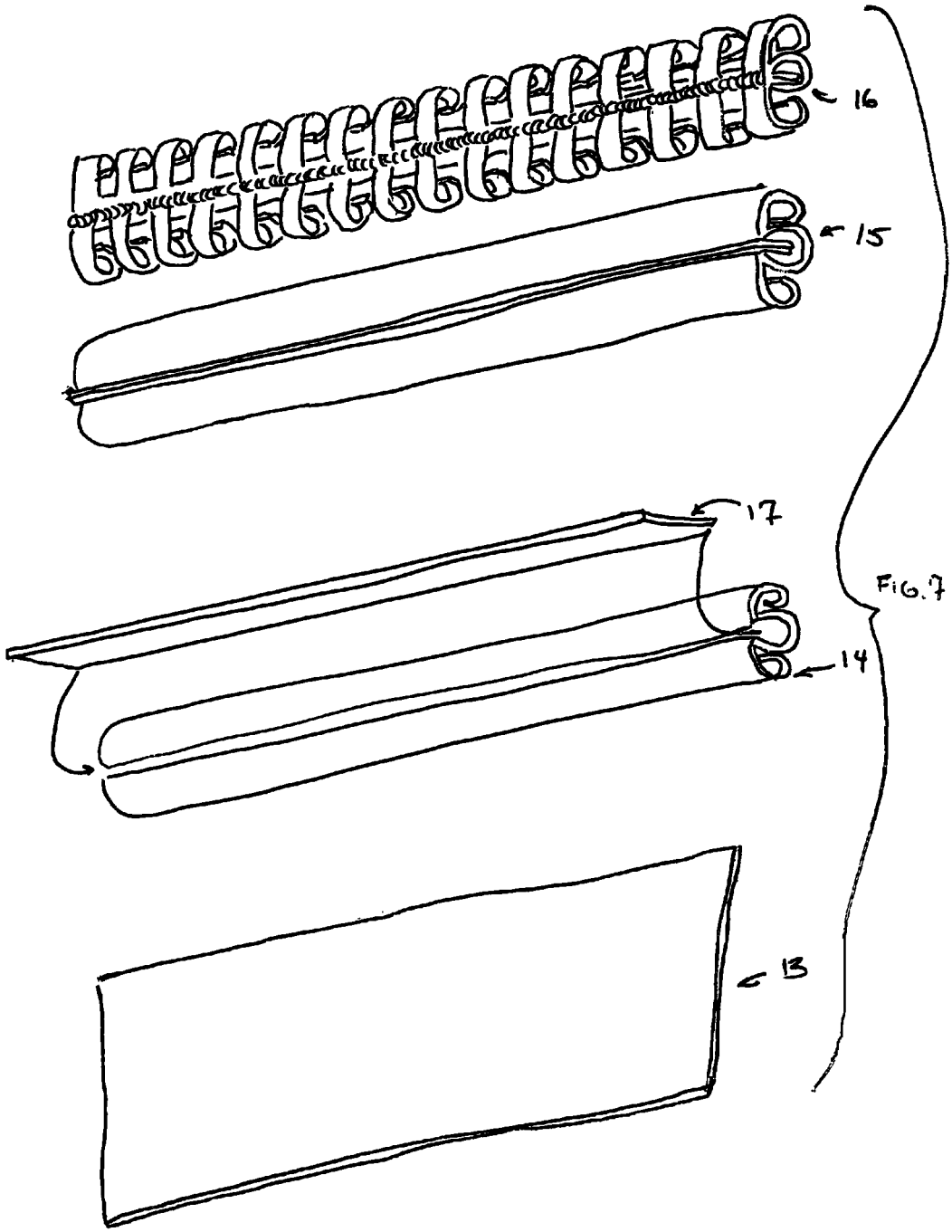
FIG. 7 is a stepwise representation of a first preferred method of construction for a heat pipe with heat dissipating fins on both sides as used in the helmet of FIG. 1.
Figure 8:
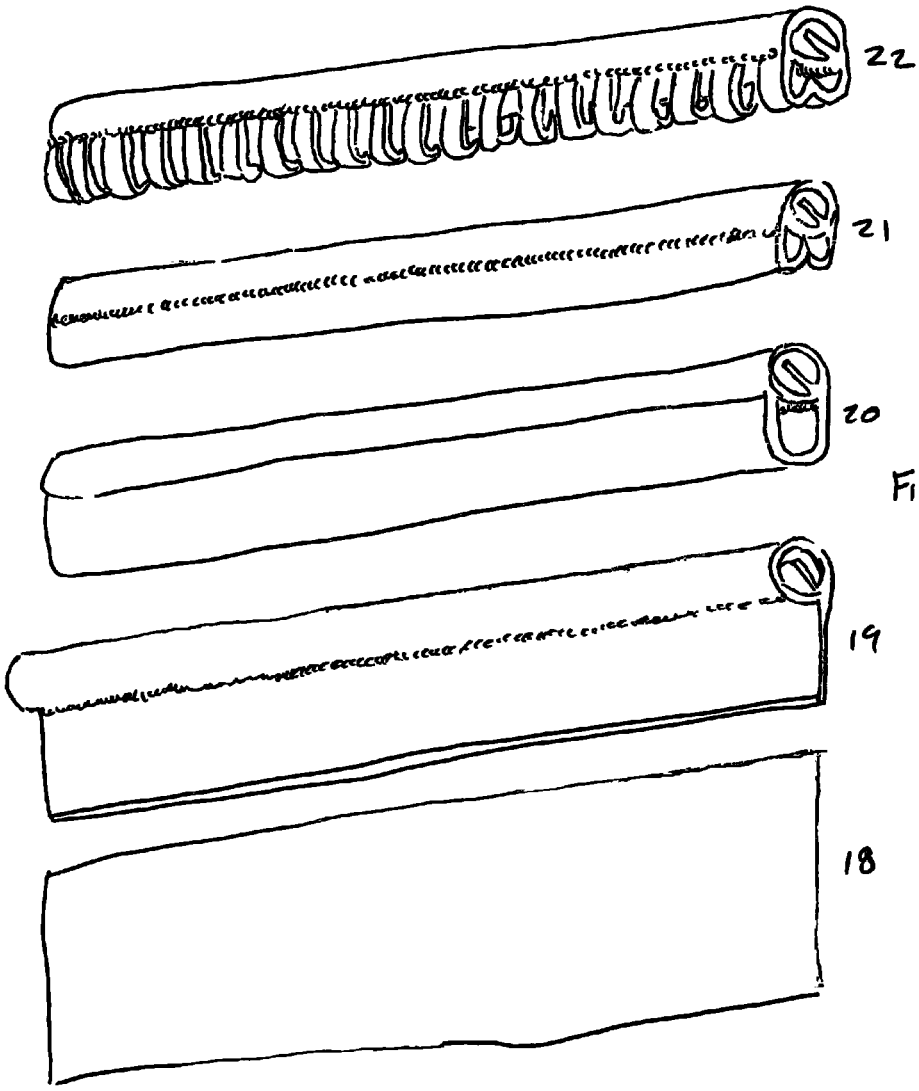
FIG. 8 is a stepwise representation of a second preferred method of construction for a heat pipe with heat dissipating fins only on one side as used in the helmet of FIG. 1.

FIGS. 7 and 8 show a detailed stepwise progression of the construction of the heat pipe segments 25 and 26. During construction of the heat pipe segments 25 and 26, internal projections of the same material as the fin arrays serve to increase the internal surface area with which the gaseous working fluid may condense upon to transfer heat to the heat pipe and therefore the fin arrays. These heat pipe segments may have bi-lateral fin arrays 29 as in segment 26 or unilateral fins 29 as in segment 25. The arrangement of these heat pipe segments 25,26 are particular to the current embodiment and may have differing arrangements with respect to the helmet 100 and the LEDs 12 depending on the arrangement. Furthermore, the arrangement of the fins 29 may differ substantially from this embodiment with respect to the number, size, configuration about the heat pipe, and shape.

Figure 5:
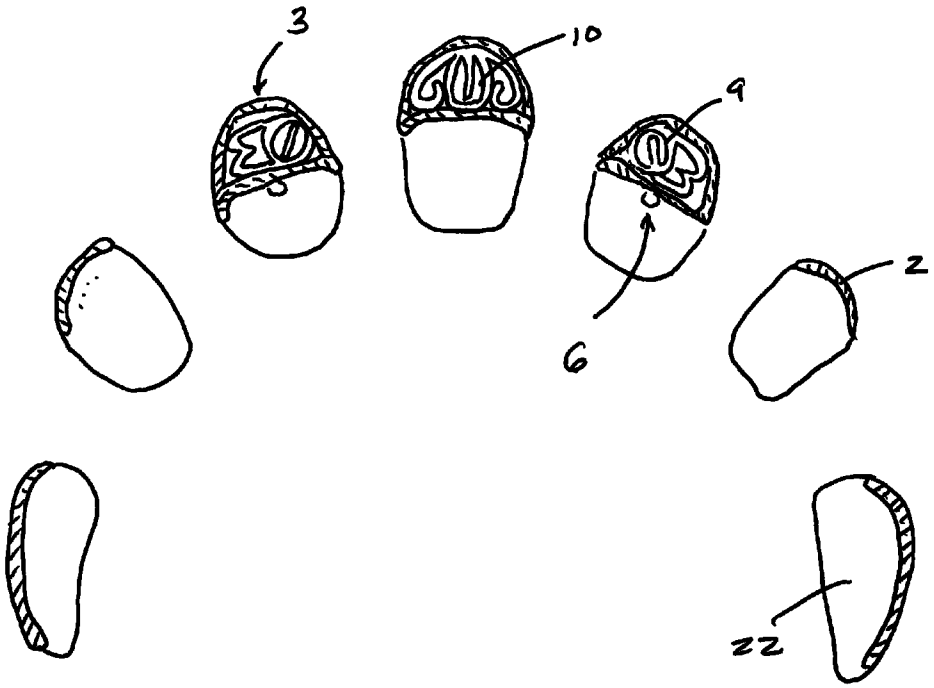
FIG. 5 is a cross section of the helmet in FIGS. 4 and 5 along line A-A.

As one can see from FIG. 2 and FIG. 6, the wiring 108 for the LED(s) 12 is enclosed within the inner surface of the primary shell 2 and exits to the exterior surface of the primary shell 12 through a bore 28 or in other embodiments multiple bores. The position of the wiring harness 6 in relation to the primary shell 2 and the inner shell 11 may be best viewed in FIG. 5. The wiring harness 6 passes out the rear of the helmet from under the primary shell 12 though another bore 27 in the foam protective shell 11 and may be secured there by means of adhesive or other to avoid migration of the wires of the wiring harness 6. In other embodiments of the helmet the wiring may be further strengthened by use of reinforcing sheathes to guard against failure of the wiring during use or the wiring terminal 1 may be incorporated into the primary shell 2 of the helmet. Of course, in other embodiments, a battery pack may be incorporated as a portion of the helmet in FIG. 1. Other constructions and/or electrical systems may be utilized in other embodiments.

The helmet 100 in FIG. 1 can provide protection to a wearer with a multipurpose day/night lighted helmet 100. The low profile of the LEDs 12 can be useful in some embodiments where wind resistance is to be minimized and to limit risk of catching the helmet on objects the wearer is moving past. The exterior shell construction in the present embodiment is comprised of the primary shell 2, the heat pipe assembly 5 and the heat pipe shell 3. The heat pipe assembly 5 in the present embodiment may serve no significant structural support for the helmet shell in the event of an impact but is constructed in a manner that allows it to preferably crush upon impact of severe enough force to in any way deform the heat pipe shell 3. The primary shell 2 may be of substantial enough strength such that the wearer is protected from impacts to the head from both the impacting surface or object as well as the elements which comprise the heat pipe assembly 5. The arrangement of these components is illustrated as an exploded in FIG. 6 and can be seen in cross section in FIG. 5. The primary shell 2 and heat pipe shell 3 in the present embodiment are composed of carbon and Kevlar weave which is laminated with adhesive resin in the final shape of the helmet shell with the heat pipe assembly 5 installed between the heat pipe shell 3 and the primary shell 2 during the construction or lamination process. Other embodiments may be constructed differently.

Figure 4:
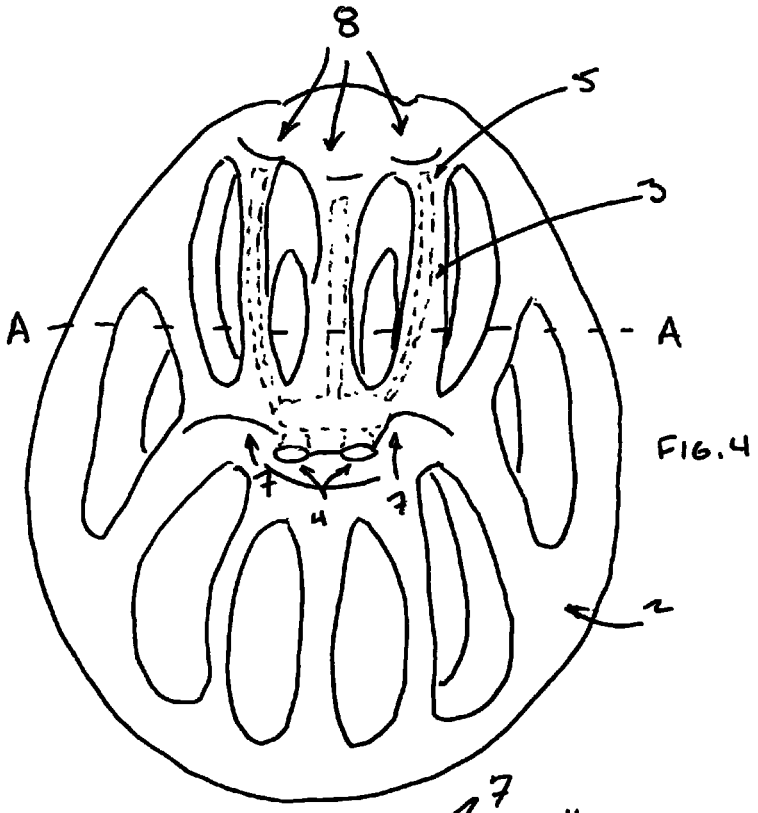
FIG. 4 is a top plan view of the helmet of FIG. 1 with the primary shell and the heat pipe shell attached and the heat pipe assembly in phantom.
Figure 3:
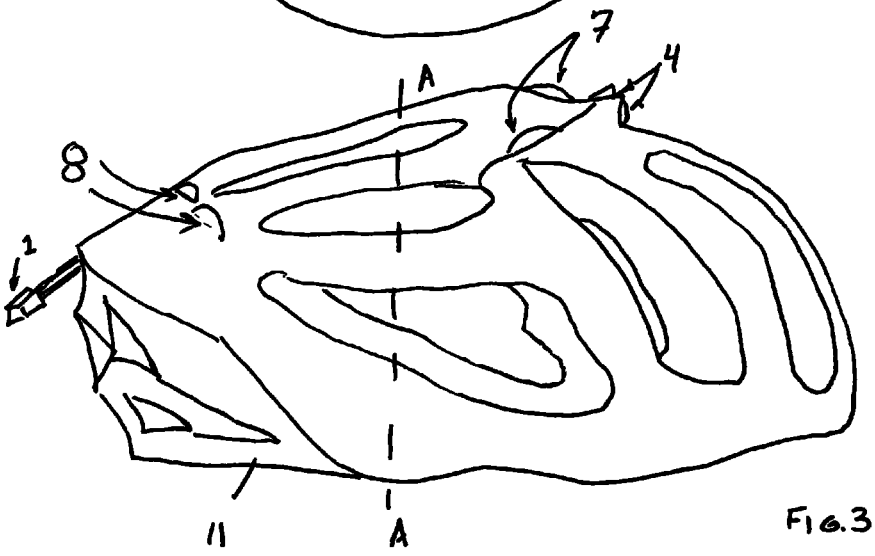
FIG. 3 is a side plan view of the helmet of FIG. 1 with both the helmet primary shell and the heat pipe shell attached.

The heat pipe shell 3 may be constructed in the current embodiment to include front vents 7 and rear vents 8 as illustrated in FIGS. 1, 3, and 4. These vents may be intended to direct air flow over the fins 29 of the heat pipe assembly 5 as the helmet moves through the air or air may be directed by other means into the vents. Moreover, the heat pipe shell 3 may serve to form a tunnel along with the upper surface of the primary shell 2 in which the heat pipe assembly 5 and/or segments 25, 26 may be at least partially enclosed. This tunnel may serve to protect the heat pipe assembly 5 and/or to direct the air flow efficiently over the fins 29 of the heat pipe segments 25 and 26 for at least some embodiments. FIG. 2 shows an orientation of the heat pipe assembly 5 in relation to the helmet primary shell 2 and FIG. 4 shows the heat pipe assembly 5 in ghost representation in relation to the heat pipe shell 3 with the heat pipe shell 3 installed.

During daytime use head lamps 12 can be utilized to increase motorists' awareness and possibly prevent the need for multiple helmets while allowing reconfiguration of helmet based on use. Furthermore, the lights 12 may be selectively turned off as would be understood by those of ordinary skill in the art. FIG. 9 shows the LEDs 12 in exploded arrangement to the heat pipe assembly 5. The mounting of the LEDs 12 to the heat pipe assembly 5 onto the pads 23 in this embodiment is with Arctic Fox™ theremal epoxy. Even though epoxy was utilized by this embodiment, other techniques can be utilized in other embodiments which might include adhesive, solders, etc., to be utilized in various embodiments. Buck driver is (not shown in illustrations) is the most common type of driver for the present embodiment while other drivers could also be utilized such as MosFET, Linear drivers or Pulse width Modulated drivers etc. A buck type driver has been utilized as it is easily accessible and virtually indestructible. Custom production of MosFET type power sources may also be utilized with commercially available components for use with the helmet in FIG. 1 once it is introduced through commercial production. Other LED drivers may be utilized in other embodiments.

The front applied optics 4 of the helmet in the present embodiment are of the front surface parabolic reflector type made of polycarbonate plastic as shown. Other embodiments may preferentially use collimating lens assemblies or reflectors of various forms in order to facilitate the particular embodiments in which they are to be used.

A wiring harness 6 may be built under the surface of the protective shell 2 and possibly totally contained within the construction of the helmet in FIG. 1. Access to replacement batteries may be provided internally or externally in various embodiments. Terminal 1 is illustrated providing power to be externally provided for LEDs 12 in the illustrated embodiment. The wiring harness 6 can provide electrical current to each of the LEDs 12 individually, in series/parallel configurations, etc., based on the needs of the particular embodiment.

LED driver assemblies could be single or multiple power sources such as a buck regulators, pulsed width modulator, MosFET amplified regulators, possibly with a computer driven modes and inputs for common control the LEDs 12. In the present embodiment the driver module for the LEDs is not shown but may in other embodiments be enclosed within the primary shell 2 for protection and may also be connected to the heat pipe assembly 5 in order to cool the driver should such cooling be required. Various embodiments may include individual mode functions for tailoring the LEDs function to the lighting situation or changing applications.

The inner cushioning shell 11 may be similar to prior art polystyrene inner shell constructions which simply have a hard plastic outer layer and can provide the wearer protection from deceleration forces such as experienced during impacts on the head. Inner shell 11 is intended to slow the rate of deceleration and distribute forces more evenly across the surface of the wearer's skull to hopefully avoid fracture and/or puncture. Various other materials and/or constructions could be utilized.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A safety helmet comprising:

a cushioning inner shell having an inner surface;

an exterior shell covering at least a portion of the cushioning layer;

a heat pipe assembly constructed of material providing heat dissipating rates at or above 5 W/m*K connected to one of the inner shell and exterior shell;

a high power LED light having a power of at least about 1 W connected to and in thermal communication with a heat pipe assembly of the exterior shell whereby the heat pipe portion provides a heat sink for the high power LED light; and wherein the heat pipe assembly comprises flat areas on an exterior surface of a tubular segment having a lumen therein and internal projections extending into the lumen dissipating heat from the flat areas.

2. The safety helmet of claim 1:

wherein the heat pipe portion extends rearwardly relative to the LED light above and along an uppermost portion of the exterior shell.

3. The heat pipe safety helmet of claim 1 comprising:

a plurality of heat pipe segments having internal projections.

4. The safety helmet of claim 3 wherein the heat pipe segment further comprise fin arrays extending from a heat pipe lumen.

5. The safety helmet of claim 1 wherein the heat pipe assembly portion transfers heat from the LEDs to a surrounding environment.

6. The safety helmet of claim 1 wherein the thermal conductivity of the heat pipe assembly is constructed of material which includes material exceeding about 200 W/m*K.

7. The safety helmet of claim 1 wherein the heat pipe assembly portion provides the heat sink for at least one LED light connected thereto.

8. The safety helmet of claim 1 wherein the heat pipe assembly portion located at least partially internally to a protective shell formed of the exterior shell and a heat pipe shell above the exterior shell.

9. The safety helmet of claim 1 wherein the LED light is connected to a pad on the heat pipe assembly and is in thermal communication with the heat pipe assembly.

10. The safety helmet of claim 1 having an outermost heat pipe shell extending over at least a portion of a heat pipe assembly and a primary protective shell.

11. The safety helmet of claim 1 further comprising a high power LED light having a power of at least about 1 W connected to and in thermal communication with the heat pipe assembly portion.

12. The safety helmet of claim 1 wherein the heat provides a heat sink for at least one LED light connected thereto.

13. The safety helmet of claim 1 wherein the heat dissipating portion has an upper surface and the LED light has an upper surface located below the upper surface of the exterior shell.

14. The safety helmet of claim 1 wherein the LED light(s) are connected to the heat pipe assembly through thermally conductive pads.

15. The safety helmet of claim 1 in which the heat pipe assembly is constructed with a working fluid capable of liquid to gas phase change in the temperature range of the desired operating temperature and have a latent heat of vaporization of at least about 800 kJ/kg.

16. The safety helmet of claim 15 wherein the heat pipe assembly interior and working fluid are under partial vacuum.

* * * * *